US005789850A

United States Patent [19]

Iwafuji et al.

[11] Patent Number: 5,789,850

[45] Date of Patent: Aug. 4, 1998

[54] DC GLOW DISCHARGE LAMP, AND IGNITION APPARATUS, FLOOD-LIGHT APPARATUS AND PROJECTOR APPARATUS FOR DC GLOW DISCHARGE LAMP

[75] Inventors: Yasuhiro Iwafuji, Kanagawa-ken; Hiromichi Kawashima; Ichiro Tanaka, both of Yokosuka; Mamoru Furuya, Kanagawa-ken; Nanao Murase, Yokohama, all of Japan

[73] Assignee: Toshiba Lighting & Technology Corporation, Tokyo, Japan

[21] Appl. No.: 799,545

[22] Filed: Feb. 13, 1997

[30] Foreign Application Priority Data

Feb. 14, 1996 [JP] Japan ..... 8-027019
Feb. 5, 1997 [JP] Japan ..... 9-022915

[51] Int. Cl.[6] ..... H01J 5/48

[52] U.S. Cl. ..... 313/318.08; 313/318.11; 313/318.07; 313/625; 313/113

[58] Field of Search ..... 313/318.08, 318.11, 313/318.07, 318.01, 635, 113, 625

[56] References Cited

U.S. PATENT DOCUMENTS 4,673,843 6/1987 Okanuma ..... 313/635
5,363,706 11/1994 Fromm et al. ..... 313/113
5,479,065 12/1995 Sugimoto ..... 313/113

*Primary Examiner*—Nimeshkumar Patel
*Attorney, Agent, or Firm*—Christensen O'Connor Johnson & Kindness PLLC

[57] ABSTRACT

A DC glow discharge lamp is disclosed, in which one the pinch seal portions of an arc tube of quartz glass with an anode and a cathode arranged therein in opposed relation to each other is bonded to a base by means of a ceramic adhesive containing a binder, and a conductive member connected around the cathode-side pinch seal portion is mounted in such a manner as to assume the same potential as the cathode. Even in the case where the binder mixed in the ceramic adhesive for improving the bonding strength is vaporized, it attaches to the conductive member and assumes a negative potential and thus is prevented from attaching to the cathode-side pinch seal portion. The devitrification of the pinch seal portion or the leakage therefrom which otherwise might occur due to the binder are thus suppressed, thereby providing a DC glow discharge lamp with an improved service life.

9 Claims, 4 Drawing Sheets

DC GLOW DISCHARGE LAMP, AND IGNITION APPARATUS, FLOOD-LIGHT APPARATUS AND PROJECTOR APPARATUS FOR DC GLOW DISCHARGE LAMP

BACKGROUND OF THE INVENTION

The present invention relates to a discharge lamp such as a DC glow metal halide lamp, an ignition apparatus for the lamp, and a flood-light apparatus and a projector apparatus using the lamp as a light source.

The invention specifically relates to a discharge lamp such as a metal halide lamp capable of preventing the devitrification of and the leakage from the pinch seal portions of an arc tube, an ignition apparatus for the lamp, and a flood-light apparatus and a projector apparatus using the lamp as a light source.

The short arc metal halide lamp, which has a high luminance and a high efficiency and superior color rendering properties, is used as a light source of a color liquid crystal projector apparatus and the like. The short arc metal halide lamp of this type, as disclosed in JP-A-4-355043, for example, comprises a hermetically seal portioned container of quartz glass, i.e., an arc tube, a pair of electrodes arranged in the container, and an arc metal such as a metal halide as a light-emitting metal, mercury as a buffer metal and an argon gas or the like as a rare gas sealed in the arc tube. The lamps available nowadays are configured of a pair of the electrodes including an anode and a cathode and turned on with a DC glow for assuring a long service life. Further, with the DC glow metal halide lamp of this type, as shown also in the above-mentioned prior art, an end of the pinch seal portions is coupled to a base using a ceramic adhesive, which base is fixed on a reflector or the like using another ceramic adhesive not shown.

The ceramic adhesive is made of a main component of silicon oxide and/or aluminum oxide and is responsible for bonding the pinch seal portions of the arc tube and the base firmly to each other or bonding the base firmly to the reflector. Specifically, the lamp and the flood-light apparatus of this type, the ceramic adhesive is subjected to thermal expansion and contraction caused by the repeated on-off heat cycles and also is often reduced in bonding strength due to an external mechanical shock, so that the arc tube and the base are liable to be displaced from their original positions. In order to prevent this inconvenience, a measure is taken to mix the ceramic adhesive of a main component of silicon oxide and/or aluminum oxide with an alkali metal such as lithium (Li), sodium (Na) or potassium (K) or an alkali earth metal such as calcium (Ca) as a binder.

In the case where Li of 3.3 wt. %, NaO of 0.2 wt. % and K of 0.7 wt. % are mixed with the ceramic adhesive, for example, it has been ascertained that the bonding strength is considerably increased as compared with when they are not so mixed. As a result, the ceramic adhesive is subjected to less thermal expansion and contraction due to heat cycles, and the bonding strength thereof is reduced less under an external mechanical shock.

In the DC glow metal halide lamp having a wall load of 50 W/cm$^2$ or more, the pinch seal section is heated to high temperatures. The rate of lighting failure inevitably increases with the lapse of service time even before the expiration of the rated life. In order to trace the causes of the lighting failure, the present inventors have examined lamps which have failed to turn on before the expiry of the rated service life, and have found that the cathode-side pinch seal portion is devitrified and the resulting leakage from the otherwise hermetic pinch seal portion has caused the lighting failure.

A more detailed examination shows that as the ceramic adhesive used for coupling the pinch seal portion, the base and the reflector to each other increases in temperature after the lamp is turned on, the binder such as Li, Na, K or Ca mixed in the ceramic adhesive for increasing the bonding strength is vaporized, and the vaporized binder flies over and attaches onto the surface of the cathode-side pinch seal portion under the attraction of the cathode of negative potential. The binder thus deposited has been found to react with the quartz glass heated to a high temperature due to the large load, gradually devitrify and adversely affect the hermeticity of the pinch seal portion, finally causing the leakage.

More specifically, the binder components such as Li, Na, K and Ca are charged positive, and the vapor of these components are attracted to the cathode-side pinch seal portion by the cathode different from them in polarity. As a result, the binder is deposited on the cathode-side pinch seal portion, and the binder, or especially, Li or Na thus deposited is attracted toward the internal conductor of the cathode, and thus gradually drawn into and reacts with the quartz glass. The devitrification thus is caused in the pinch seal portion, thereby finally giving rise to a leakage.

BRIEF SUMMARY OF THE INVENTION

The object of the present invention is to provide a DC glow discharge lamp, an ignition apparatus, a flood-light apparatus and a projector apparatus for the DC glow discharge lamp, in which the binder such as Li or Na mixed with the ceramic adhesive to increase the bonding strength thereof is prevented from attaching to the pinch seal portion on cathode side, thereby preventing the devitrification of and the leakage from the pinch seal portion for an improved service life.

In order to achieve the above-mentioned object, according to the present invention, there is provided a discharge lamp comprising a hermetically sealed container, a plurality of mounting members fixedly mounted at least on one of the pinch seal portions of the hermetically sealed container, a ceramic adhesive containing a binder made of at least one of lithium and sodium as the main component thereof for bonding the pinch seal portions of the hermetically sealed container and the mounting members, and a conductive member arranged around the cathode-side pinch seal portion and electrically connected to maintain the same potential as the cathode.

The DC glow discharge lamp according to the invention includes a metal halide lamp, a mercury lamp or a xenon lamp. A discharge medium such as mercury, metal halide or xenon gas is contained in the lamp. The mounting members mounted on the pinch seal portions include the base, the reflector and other lamp accessories bonded using the ceramic adhesive.

The mounting members may be mounted on the two pinch seal portions formed at the ends of the hermetically sealed container or only on one of the pinch seal portions. According to the invention, the mounting members are effectively mounted only on the pinch seal portion on the anode side. The conductive member, on the other hand, includes a conductive wire, a conductive plate or a conductive film and may be used to surround or is partially added to the cathode-side pinch seal portion.

The binder contained in the ceramic binder is made of an alkali metal such as lithium (Li), sodium (Na) or potassium (K) or an alkali earth metal such as calcium (Ca). The main components of the binder, however, include at least one of Li and Na. The higher the content of the binder, the higher the bonding strength. The resulting increase in the vaporization, however, causes a large amount of binder components to be deposited on the cathode-side pinch seal portion.

According to this aspect of the invention, in which the conductive member is arranged around the cathode-side pinch seal portion and electrically connected to assure the same potential as the cathode, the main binder components such as Li and Na of positive potential vaporized from the ceramic adhesive are attracted to and deposited on the conductive member around the cathode-side pinch seal portion. The binder components thus deposited on the conductive member stay there and are not drawn into the quartz glass. As a result, the binder is prevented from reacting with the quartz glass, thereby suppressing the devitrification of and the leakage from the pinch seal portion.

According to a preferred embodiment of the invention, a metal oxide film is formed around the cathode-side pinch seal portion.

According to this aspect of the invention, the metal oxide film is formed around the cathode-side pinch seal portion, and therefore, the main binder components such as Li and Na of positive potential which may be vaporized from the ceramic adhesive and attracted to the cathode-side pinch seal portion, are deposited on the metal oxide film. The binder components thus are prevented from coming into contact with the quartz glass by the metal oxide film. Consequently, the binder is prevented from reacting with the quartz glass, thereby suppressing the devitrification of and the leakage from the pinch seal portion.

According to another preferred embodiment of the invention, the capacity of the metal oxide film to seal the alkali metal and the alkali earth metal is $5.0\times10^{-6}$ g/cm$^2$ or less.

The capacity of the metal oxide film to seal the alkali metal and the alkali earth metal is the ability to block the alkali metal and the alkali earth metal from penetrating through the quartz glass and is expressed by the amount of the alkali metal and the alkali earth metal present in the unit area of the film. A metal oxide film having the sealing capacity of $5.0\times10^{-6}$ g/cm$^2$ or less can effectively block the binder components from being drawn into the quartz glass.

According a more preferred embodiment of the invention, the metal oxide film has the main component of at least one of silicon oxide and aluminum oxide.

The capacity of $SiO_2$ and $Al_2O_3$ to seal the alkali metal and the alkali earth metal is not more than $5.0\times10^{-6}$ g/cm$^2$. A metal oxide film having the main components including at least one of $SiO_2$ and $Al_2O_3$ can therefore effectively prevent the binder components from being drawn into the quartz glass. Among all metal oxides, $SiO_2$ and $Al_2O_3$ easily form a film and the manufacturing cost can be reduced.

According to still another preferred embodiment of the invention, the metal oxide film with the main components of at least one of silicon oxide and aluminum oxide contains not more than 5 ppm of an alkali metal and an alkali earth metal.

The $SiO_2$ and/or the $Al_2O_3$ film formed on the pinch seal portion would be deteriorated in sealing capacity if they already contain an alkali metal or an alkali earth metal. The metal oxide film, therefore, desirably has a high purity. A high sealing capacity can thus be exhibited by maintaining a high purity of the $SiO_2$ and/or $Al_2O_3$ film with the content of the alkali metal or the alkali earth metal thereof kept at 5 ppm or less.

According to a further preferred embodiment of the invention, the adhesive contains a binder of less than 0.3 wt. % but not less than 0.05 wt. % with the main components of at least one of lithium and sodium.

According to this aspect of the invention, the binder components are prevented from being drawn into the quartz glass and from reacting with the quartz glass thereby to obviate such troubles as the devitrification of and the leakage from the pinch seal portion, while at the same time securing the minimum bonding strength of the adhesive.

Additional objects and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
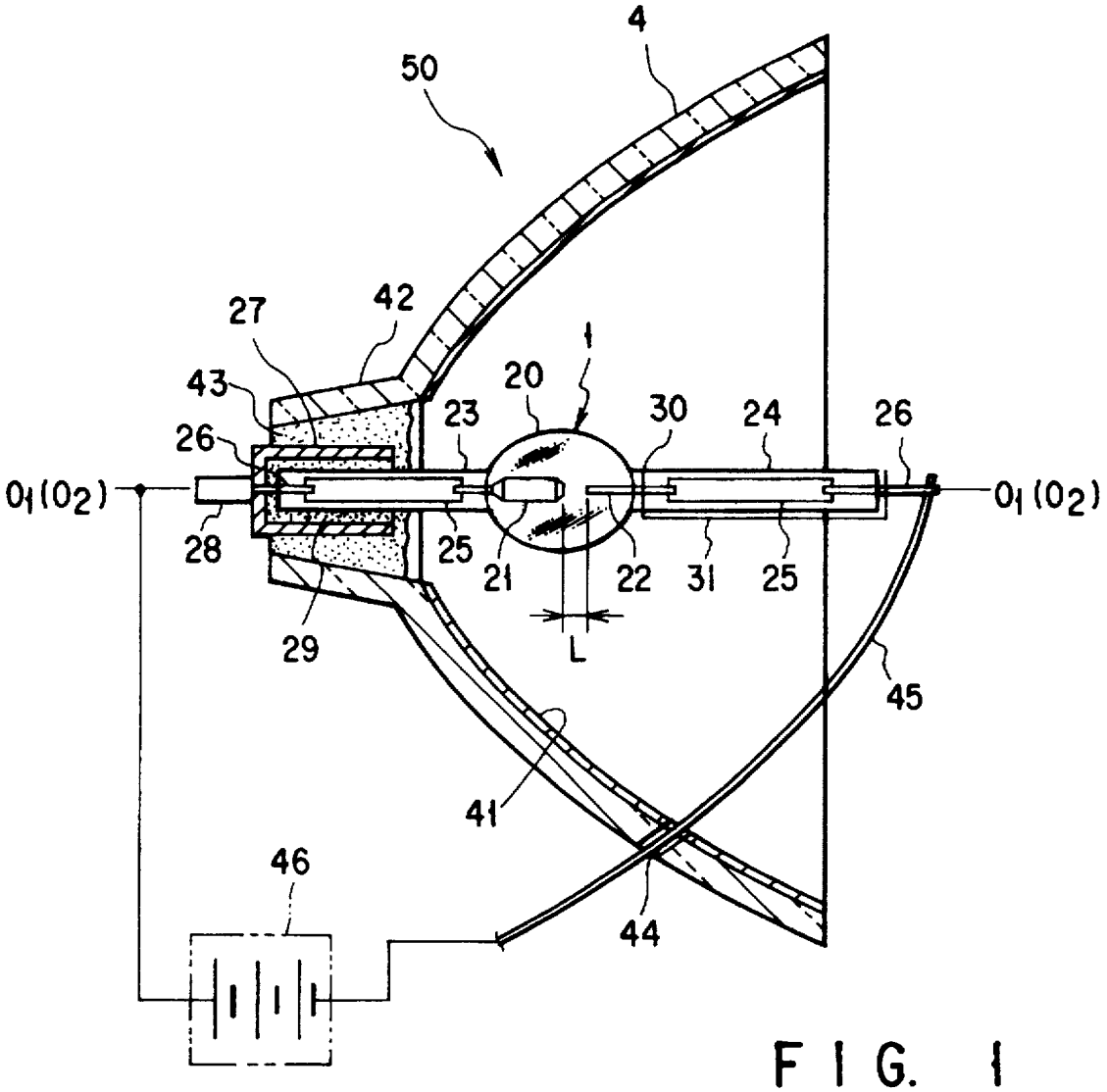
FIG. 1 is a sectional view showing a structure of a flood-light apparatus 50 configured with a short arc metal halide lamp mounted on a reflector according to a first embodiment of the invention.
Figure 2:
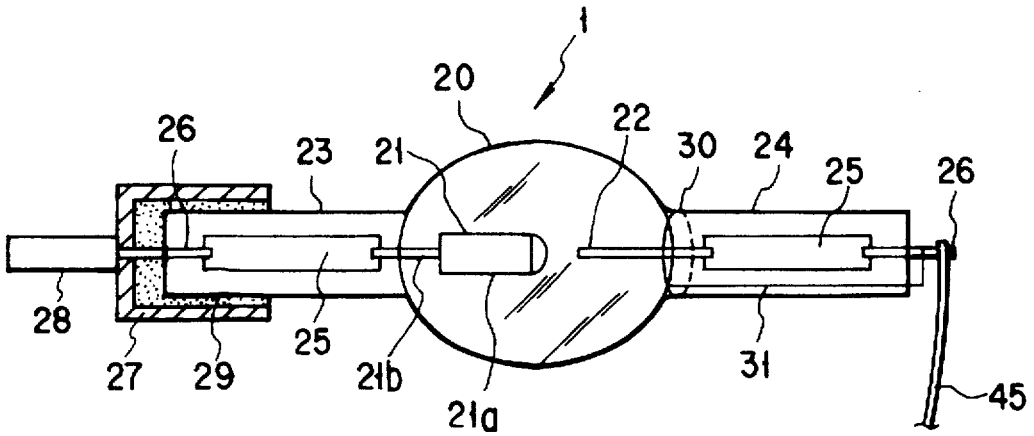
FIG. 2 is a side view showing a short arc metal halide lamp according to the first embodiment.
Figure 3:
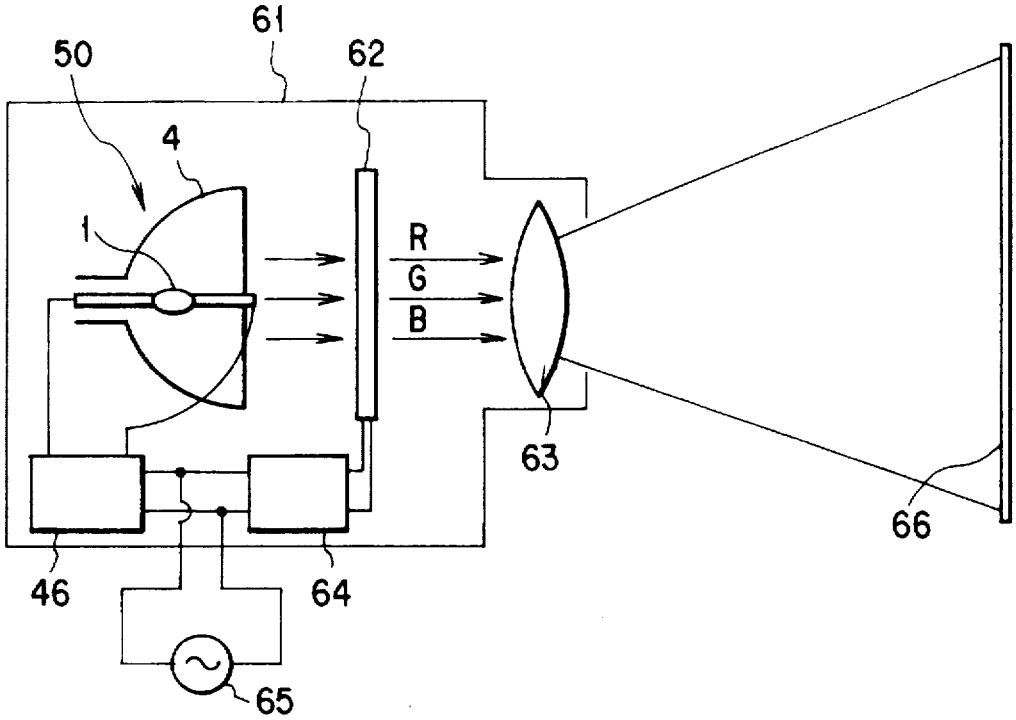
FIG. 3 is a side view schematically showing a configuration of a color liquid crystal projector apparatus according to the same embodiment.
Figure 4:
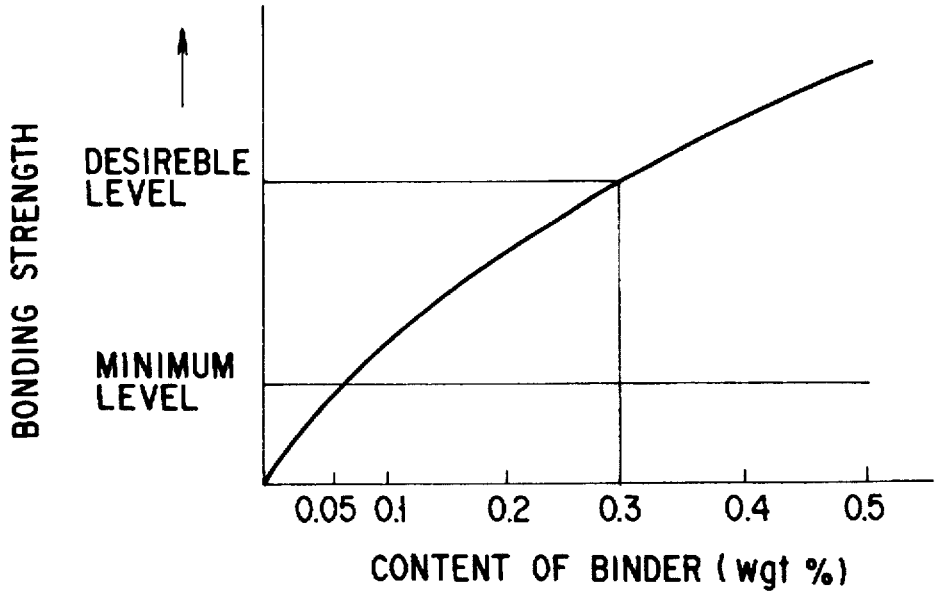
FIG. 4 is a characteristic diagram showing the relation between the binder content and the bonding strength.

The present invention will be explained below with reference to the first embodiment shown in FIGS. 1 to 4. FIG. 1 is a sectional view showing a structure of a flood-light apparatus 50 configured with a short arc metal halide lamp 1 mounted on a reflector 4. FIG. 2 is a side view showing the short arc metal halide lamp 1. FIG. 3 is a diagram showing a configuration of a color liquid crystal projector apparatus, and FIG. 4 is a characteristic diagram showing the relation between the content of the binder and the bonding strength.

The short arc metal halide lamp 1 shown in FIGS. 1 and 2 has a rated lamp power of 250 W, a rated lamp voltage of 65 V, and a rated lamp current of 3.8 A, and includes a hermetically seal portioned container 20, i.e., an arc tube made of quartz glass. The arc tube 20 includes a spherical or elliptical discharge space and has a maximum outer diameter of about 14 mm, an inner surface area of about 5.0 $cm^2$, and a tube wall load of not less than 50 $W/cm^2$ or, say, about 65 $W/cm^2$.

The discharge space has arranged therein a pair of electrodes 21, 22, which constitute an anode 21 and a cathode 22, respectively. The anode 21 and the cathode 22 are arranged in opposed relation spaced from each other by a distance L of not more than 10 mm or, say, 3.0 mm.

The anode 21 includes a large-sized main electrode body 21*a* at the forward end thereof and an anode axial portion 21 contiguous with the main electrode body 21*a*. The cathode 22, on the other hand, is formed of a linear tungsten wire having a diameter of, say, 0.7 mm.

The electrodes 21, 22 are connected to metal foil conductors 25, 25 sealed to the pinch seal portions 23, 24, respectively, formed at the ends of the arc tube 20. Specifically, the anode axial portion 21*a* of the anode 21 is coupled to the metal foil conductor 25 of one pinch seal portion 23, while the cathode 22 is coupled to the metal foil conductor 25 of the other pinch seal portion 23. The metal foil conductors 25, 25 are configured of a molybdenum foil having a thickness of about 30 μm and a width of about 3 mm. These metal foil conductors 25, 25 are connected to external lead wires 26, 26, respectively.

The arc tube 20 has sealed therein a metal halide as a light-emitting metal, mercury as a buffer metal and a rare gas such as argon.

The metal halide is an iodide and/or a bromide of at least selected one of the rare earth metals including dysprosium (Dy), neodymium (Nd), holmium (Ho) and thurium (Tm), an iodide and/or a bromide of at least selected one of indium (In), tharium (Tl), gallium (Ga), zinc (Zn) and cadmium (Cd), and an iodide and/or a bromide of cesium (Cs). The total amount of the metal halide thus sealed is about 2.0 mg, for example, while 34 mg of mercury Hg and 500 Torr of Ar are also sealed.

The pinch seal portion 23 on the anode 21 side of the arc tube 20 has mounted thereon a base 27. The base 27 is made of a heat-resistant insulating material such as ceramics, and is covered on the end of the anode-side pinch seal portion 23. The base 27 has a terminal pin 28 protruded from the end thereof and connected with an external lead wire 26. The base 27 is coupled to the anode-side pinch seal portion 23 by means of a ceramic adhesive 29.

The ceramic adhesive 29 is made of main components of silicon oxide and/or aluminum oxide mixed with a binder of such an alkali metal as lithium (Li), sodium Na or potassium (K) or such an alkali earth metal as calcium (Ca). This binder contains 3.3 wt. % of Li, 0.2 wt. % of Na and 0.7 wt. % of K, for example, so that the content of the binder in the adhesive is 4.2 wt. %.

According to this embodiment, a conductive member 30 is mounted in the vicinity of the root of the cathode 22 in the cathode-side pinch seal portion 24. The conductive member 30 is made of a conductive wire, a conductive plate (including a band or a foil) or a conductive film, and arranged in such a position as to surround the whole periphery of the pinch seal portion 24. The conductive member 30 may not necessarily surround the whole periphery but may surround more than the whole periphery of the pinch seal portion 24. This conductive member 30 is electrically connected to the external lead wire 26 on cathode side through a connecting wire 31 made of a conductive wire, a conductive plate (including a band or a foil) or a conductive film. As a result, the conductive member 30 is configured to assume the same potential as the cathode 22.

This short arc metal halide lamp 1 is mounted on the reflector 4 and constitutes a flood-light apparatus 50. The reflector 4 is made of glass or metal, and has a reflective surface 41 made of a film of $TiO_2$—$SiO_2$ or the like having a superior reflection characteristic deposited by evaporation on an elliptic or parabolic inner rotatable curved surface. This reflector 4 has an open front constituting a projecting portion.

A support cylinder 42 is arranged at the vertex on the back of the reflector 4. The support cylinder 42 has the base 27 of the lamp 1 fixed thereto by means of the ceramic adhesive 43. The ceramic adhesive 43 may be similar to the ceramic adhesive 29 used for bonding the base 27 to the arc tube 20.

This coupled relation causes the lamp 1 to be fixedly mounted on the reflector 4 in such a manner that the line (lamp axis) $O_1$—$O_1$ connecting a pair of the electrodes 21, 22 of the lamp 1 coincides with the center axis of the reflector 4, i.e., the optical axis $O_2$—$O_2$. The optical axis $O_2$—$O_2$ is arranged substantially in horizontal direction and therefore the lamp 1 is turned on to project light in horizontal direction.

The lamp 1 mounted on the reflector 4 has the anode 21 side of the arc tube 20 located on the support cylinder 42 side of the reflector 4, and the cathode 22 side thereof located on the front projecting portion side of the reflector 4.

The reflector 4 is formed with a lead-in hole 44, through which a power feed line 45 is connected to an external lead wire 26 introduced from the pinch seal portion 24 on the cathode 22 side of the lamp 1, thereby leading the power feed line 45 to the rear side of the reflector 4.

The lamp 1 has a terminal pin 28 and the power feed line 45 connected to a power supply means 46 including an AC/DC converter and the like and thus constitutes an ignition apparatus. This power supply means 46 is adapted to supply DC power in such a manner as to maintain the rated lamp power of 250 W for the lamp 1.

This flood-light apparatus 50 is used with a color liquid crystal projector apparatus as shown in FIG. 3, for example. In FIG. 3, numeral 61 designates a housing constituting a body of the color liquid crystal projector apparatus. This housing 61 contains therein the flood-light apparatus 50, a liquid crystal display panel 62 and an optical system 63 including a lens. The housing 61 also includes the power supply means 46 having the AC/DC converter and a liquid crystal driver 64. The power supply means 46 and the liquid crystal driver 64 are connected to a commercial power supply 65.

Upon turning on of the lamp 1 by the power supplied from the power supply means 46, the light emitted from the lamp 1 is reflected by the reflector 4 and irradiated on the liquid crystal display panel 62. The liquid crystal display panel 62 includes RGB color filters not shown corresponding to the pixels of the respective colors. The color filters are controlled by the liquid crystal driver 64. The light that has been transmitted through the liquid crystal display panel 62 is colored by one of the RGB color filters and the resulting colored light is focused by the optical system 63 and projected on a screen 66. As a result, a color picture which has been image-controlled by the liquid crystal display panel 62 is displayed on the screen 66.

In the metal halide lamp 1 having this configuration, the temperature of the arc tube 20 turned on increases and the heat of the arc tube 20 is transmitted to the pinch seal portions 23, 24 by irradiation or conduction. The pinch seal portion 23 on anode side is coupled with the base 27 through the ceramic adhesive 29, which base 27 in turn is coupled to the support cylinder 42 of the reflector 4 through another ceramic adhesive 43. With the temperature increase of the pinch seal portion 23, therefore, the ceramic adhesives 29 and 43 also increase in temperature, so that the binder with the main components of Li and Na mixed in the ceramic adhesives 29 and 43 is vaporized. The vapor of the binder assumes a positive potential, tends to be attracted to the cathode, and attached to and deposited on the surface of the cathode-side pinch seal portion 24.

According to this embodiment, however, the conductive member 30 is arranged around the pinch seal portion 24 on cathode side, and is connected to the external lead wire 26 on cathode side through the connecting wire 31. Therefore, the conductive member 30 assumes the same electric potential as the cathode 22, with the result that the binder containing the main components of Li and Na vaporized from the ceramic adhesives is attracted to and captured by the conductive member 30. Thus the binder is prevented from being attached on the surface of the pinch seal portion 24.

The binder components attached on the conductive member 30 assumes a negative potential at the same level as the metal foil conductor 25 and the cathode 22 in the cathode-side pinch seal portion 24. The binder components thus are subjected to the repulsive force from the cathode 22 and the metal foil conductor 25, and thereby is prevented from being drawn into the quartz glass. As a consequence, the binder is prevented from reacting with the quartz glass, thereby making it possible to obviate the inconveniences of the devitrification of the pinch seal portion 24 or the leakage which otherwise might be caused as a result of the loss of hermeticity of the pinch seal portion 24. Thus the problem of the lamp failing to turn on before the rated service life thereof is obviated, thereby leading to a longer service life thereof.

The short arc metal halide lamp 1 according to the above-mentioned embodiment has a rated lamp power of 250 W, a rated lamp voltage of 65 V, a rated lamp current of 3.8 A, and a tube wall load of not less than 50 W/cm$^2$ or, say, about 65 W/cm$^2$. Also, the cathode 22 is formed of a tungsten wire 0.7 mm in diameter. The current density of the cathode, therefore, is 10.0 A/mm$^2$.

In the case where this lamp is turned on, the temperature of the pinch seal portion 24 at the root of the cathode reaches as high as 500° C. or more. This high temperature is liable to promote the reaction between the quartz glass and the binder with the main components of Li and Na which may attach to the pinch seal portion 24.

Discharge is likely to take place at the surface of the arc tube 20, in a region between the conductive member 30 and the anode 21. It is therefore desired that the member 30 be spaced apart from the arc tube 20.

However, the content of the binder is a factor affecting the bonding strength, and therefore cannot be reduced to zero. FIG. 4 is a characteristic diagram showing the result of examining the relation between the content of the binder (wt. %) and the corresponding bonding strength in the absence of the conductive member 30 in the lamp having the specification described above. FIG. 4 indicates that the bonding strength of the ceramic adhesives 29 and 43 increases with the content of the binder. For the minimum required bonding strength to be maintained, the binder content is required to be at least 0.05 wt. %, or desirably, 0.3 wt. % or more.

The conventional ceramic adhesives 29 and 43 contain the binder of 4.2 wt. % and has a sufficiently large bonding strength. In spite of this, the amount of vaporization is so large during the turned-on state that the binder is liable to be deposited on the pinch seal portion 24 on cathode side.

The result of an experiment conducted on this lamp applying the present embodiment is shown in Table 1 below. Table 1 illustrates the rate of occurrence of the lighting failure of the lamp with respect to the turned-on time using a ceramic adhesive with the binder content of 4.2 wt. %.

TABLE 1

| Binder Content 4.2 wt. % | | | |
|---|---|---|---|
| | Lighting Failure Rate % | | |
| | | With Conductive Member | |
| Turned-On Time (Hrs) | Without Conductive Member | Not Connected with Cathode | Connected with Cathode at Same Potential |
| 100 | 0 | 0 | 0 |
| 300 | 3 | 2 | 0 |
| 500 | 8 | 5 | 0 |
| 1000 | 15 | 10 | 0 |
| 1500 | 35 | 25 | 0 |
| 2000 | 55 | 40 | 0 |
| 3000 | 60 | 45 | 0 |

Table 1 shows that a glow discharge lamp having the pinch seal portion 24 lacking the conductive member 30 or a glow discharge lamp with the conductive member 30 not connected at the same potential as the cathode increases in the rate of occurrence of lighting failure with the lapse of turned-on time. A glow discharge lamp having the pinch seal portion 24 with the conductive member 30 connected at the same potential as the cathode, by contrast, develops no lighting failure to the end of the service life, and thus has attained a satisfactory result.

Table 2 below, on the other hand, shows the rate of occurrence of lighting failure with the turned-on time for the case using a ceramic adhesive with the binder content reduced to 0.3 wt. %.

TABLE 2

| Binder Content 0.3 wt. % | | | |
|---|---|---|---|
| | Lighting Failure Rate % | | |
| | | With Conductive Member | |
| Turned-On Time (Hrs) | Without Conductive Member | Not Connected with Cathode | Connected with Cathode at Same Potential |
| 100 | 0 | 0 | 0 |
| 300 | 2 | 1 | 0 |
| 500 | 4 | 3 | 0 |
| 1000 | 10 | 7 | 0 |
| 1500 | 25 | 10 | 0 |
| 2000 | 30 | 21 | 0 |
| 3000 | 40 | 27 | 0 |

Table 2 shows that a glow discharge lamp having the pinch seal portion 24 lacking the conductive member 30 or a glow discharge lamp having the conductive member 30 not connected at the same potential as the cathode has a lighting failure rate increasing with the lapse of the turned-on time. A glow discharge lamp having the pinch seal portion 24 with the conductive member 30 connected at the same potential as the cathode, by contrast, develops no lighting failure to the end of the service life and exhibits a satisfactory result.

The above-mentioned experimental result indicates that the short arc metal halide lamp 1 according to the first embodiment has the pinch seal portion 24 being prevented from being devitrified or from leakage, thereby improving the lamp life.

Also, the ceramic adhesive preferably contains the binder with at least one of lithium and sodium of 0.3 wt. % or more as a main component thereof. Specifically, the ceramic adhesives 29, 43 with a higher content of the binder increases the amount of vaporization during the turned-on state with an increased amount of the binder deposited on the pinch seal portion 24 on cathode side. In view of this, the content of the binder is preferably less or zero. As seen from FIG. 4, however, the binder is mixed for increasing the bonding strength of the ceramic adhesives, so that a decreased amount of the binder would reduce the bonding strength of the ceramic adhesives making it impossible to maintain the fixed state over a long period of time. In the case where the content of the binder is not less than 0.3 wt. %, the bonding strength can be maintained at high level at the probable sacrifice of an increased amount of vaporization. For the binder content of 0.3 wt. % or more, as in the present embodiment, the use of the conductive member 30 therefore effectively prevents the devitrification of and the leakage from the pinch seal portion 24.

The ignition apparatus and the flood-light apparatus 50 using the short arc halide lamp 1 as a light source and the color liquid crystal projector apparatus using them as shown in FIG. 3 are all improved in their service life.

Figure 5:
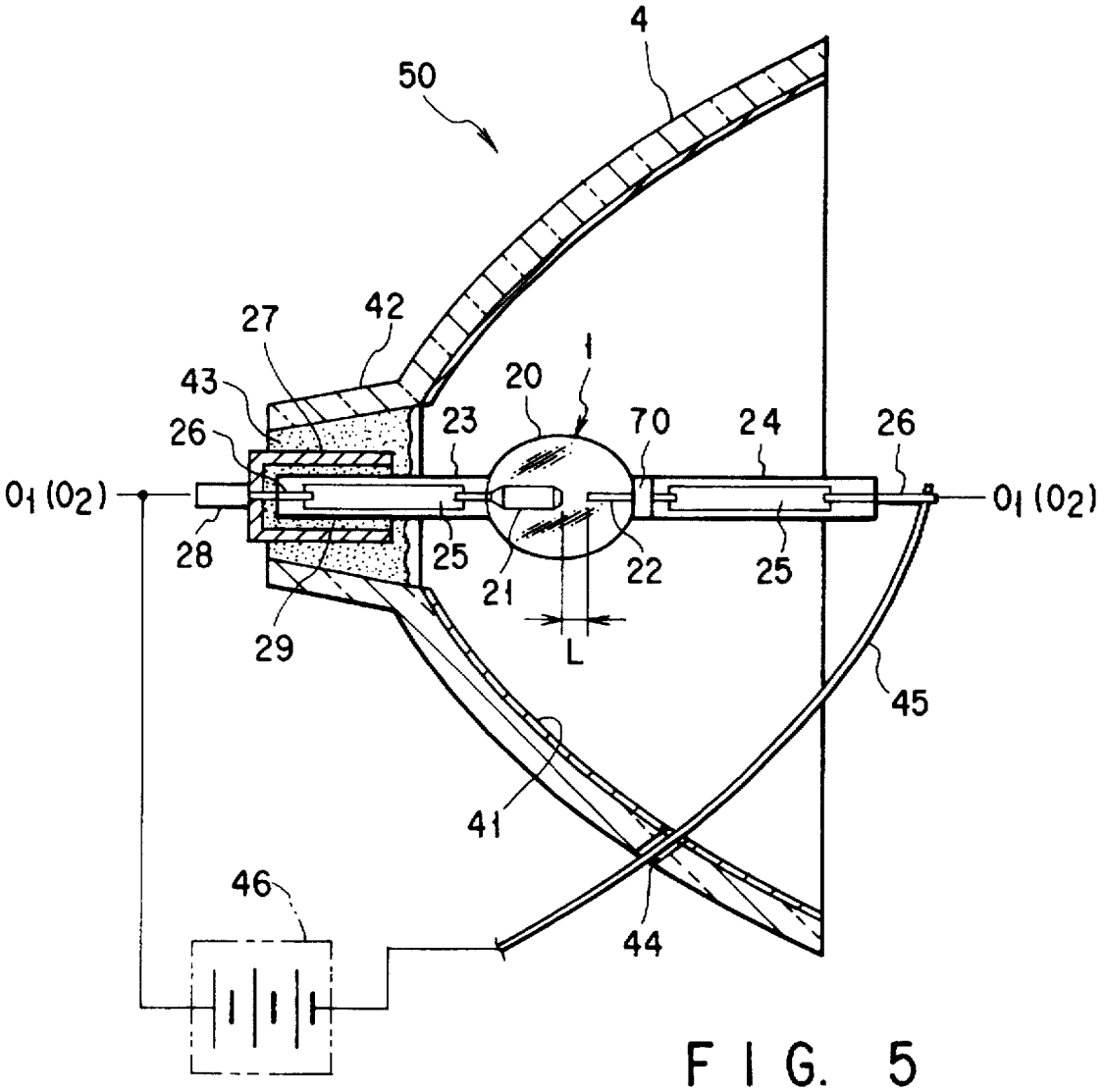
FIG. 5 is a sectional view showing a structure of a flood-light apparatus configured with a short arc metal halide lamp mounted on a reflector according to a second embodiment.
Figure 6:
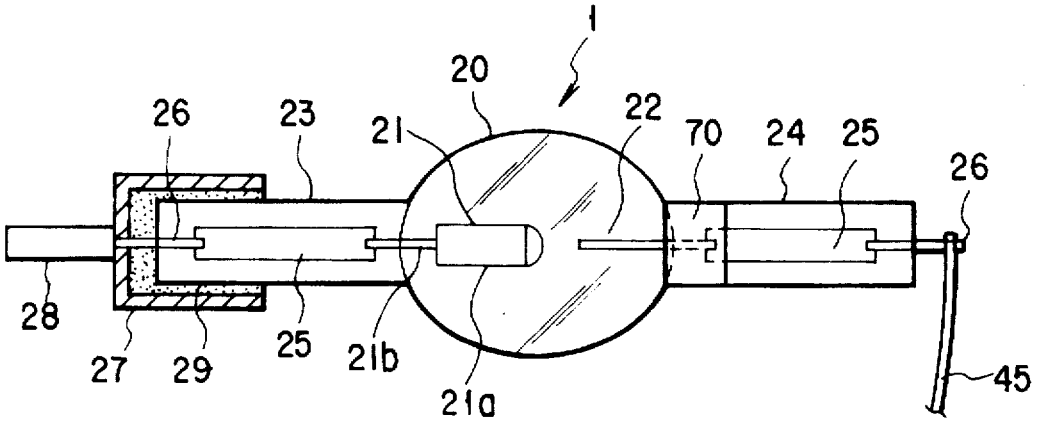
FIG. 6 is a side view showing a short arc metal halide lamp according to the second embodiment.

The present invention is not limited to the first embodiment. A second embodiment of the invention will be explained with reference to FIGS. 5 and 6. FIG. 5 is a sectional view showing a structure of the flood-light apparatus 50 configured with the short arc halide lamp 1 mounted on the reflector 4. FIG. 6 is a side view showing the short arc halide lamp 1.

In these drawings, the same component parts as those in the first embodiment shown in FIGS. 1 and 2 are designated by the same reference numerals, respectively, and will not be described. The present embodiment is different from the first embodiment in that although the conductive member 30 according to the first embodiment is mounted on the pinch seal portion 24 on cathode side and is connected to assume the same potential level as the cathode 22, the conductive member 30 is eliminated and a film 70 made of a metal oxide is formed on the pinch seal portion 24 on cathode side in the vicinity of the root of the cathode 22 according to this embodiment.

The metal oxide film 70 is made of, for example, at least one of silicon oxide ($SiO_2$), aluminum oxide ($Al_2O_3$), titanium oxide ($TiO_2$), zinc oxide (ZnO) and the like metal oxide, and preferably composed of at least one of $SiO_2$ and $Al_2O_3$ as a main component.

The metal oxide film 70 of $SiO_2$ and/or $Al_2O_3$ as the main component thereof has a high purity containing not more than 5 ppm of an alkali metal and an alkali earth metal. The sealing capacity of the alkali metal and the alkali earth metal is not more than $5.0\times10^{-6}$ g/cm$^2$.

With the short arc metal halide lamp 1 formed with the metal oxide film 70 having this configuration, an increased temperature of the pinch seal portion 23 in turned-on state causes the binder mixed in the ceramic adhesive 29 containing Li or Na as the main component thereof is vaporized and attracted to the cathode and tends to be attached and deposited on the surface of the cathode-side pinch seal portion 24. According to the present embodiment, however, the presence of the metal oxide film 70 formed around the cathode-side pinch seal portion 24 causes the flying binder components to attach to the metal oxide film 70 and prevents them from directly attaching to the surface of the pinch seal portion 24.

As a result, the binder components are prevented from being drawn into the quartz glass, which in turn prevents the binder from reacting with the quartz glass of the pinch seal portion 24. In this way, such inconveniences as the devitrification of the pinch seal portion 24 or the loss of hermeticity of the pinch seal portion 24 and the resulting leakage are prevented. The troubles including the lighting failure of the lamp occurring before the expiry of its rated life can thus be obviated for an improved service life.

In the case where the film 70 made of a metal oxide material is formed of $SiO_2$ and/or $Al_2O_3$ as the main component thereof, the sealing capacity of the alkali metal and the alkali earth metal including $SiO_2$ and $Al_2O_3$ is not more than $5.0\times10^{-6}$ g/cm$^2$. The binder components thus are efficiently prevented from being drawn into the quartz glass. In addition, among all the metal oxides, $SiO_2$ and $Al_2O_3$ films are easier to form and inexpensive.

In the case where the capacity of the metal oxide film 70 to seal the alkali metal and the alkali earth metal is not more than $5.0\times10^{-6}$ g/cm$^2$, the metal oxide film prevents the binder components from being drawn into the quartz glass. It is thus possible to prevent the binder from reacting with the quartz glass and thereby prevent the devitrification of and the leak from the pinch seal portion. Also, in the case where the content of the alkali metal and the alkali earth metal in the metal oxide film 70 is not more than 5 ppm, a high sealing capacity is exhibited by the metal oxide film against the binding components.

The result of an experiment conducted on this embodiment is shown in Table 3 below. Table 3 shows the rate of occurrence of the lighting failure with respect to the turned-on time of the lamp using a ceramic adhesive containing 0.3 wt. % of the binder.

TABLE 3

| Binder Content 0.3 wt. % | | |
|---|---|---|
| | Lighting Failure Rate % | |
| Turned-On Time (Hrs) | Without Metal Oxide Film | With Metal Oxide Film |
| 100 | 0 | 0 |
| 300 | 2 | 0 |
| 500 | 4 | 0 |
| 1000 | 10 | 0 |
| 1500 | 25 | 0 |
| 2000 | 30 | 0 |
| 3000 | 40 | 0 |

Table 3 indicates that a glow discharge lamp lacking the metal oxide film 70 in the pinch seal portion 24 has a higher rate of occurrence of lamp lighting failure with the lapse of the turned-on time. The lamp with the metal oxide film 70 in the pinch seal portion 24, by contrast, develops no lamp lighting failure before the end of the service life and has a satisfactory result.

In the case where the binder content is not less than 0.3 wt. %, the provision of the metal oxide film 70 as in the present embodiment can prevent the devitrification and leakage from the pinch seal portion 24.

Consequently, the ignition apparatus and the flood-light apparatus 50 using this short arc metal halide lamp 1 as a light source and the color liquid crystal projector apparatus shown in FIG. 3 using them are improved in the service life thereof.

Figure 7:
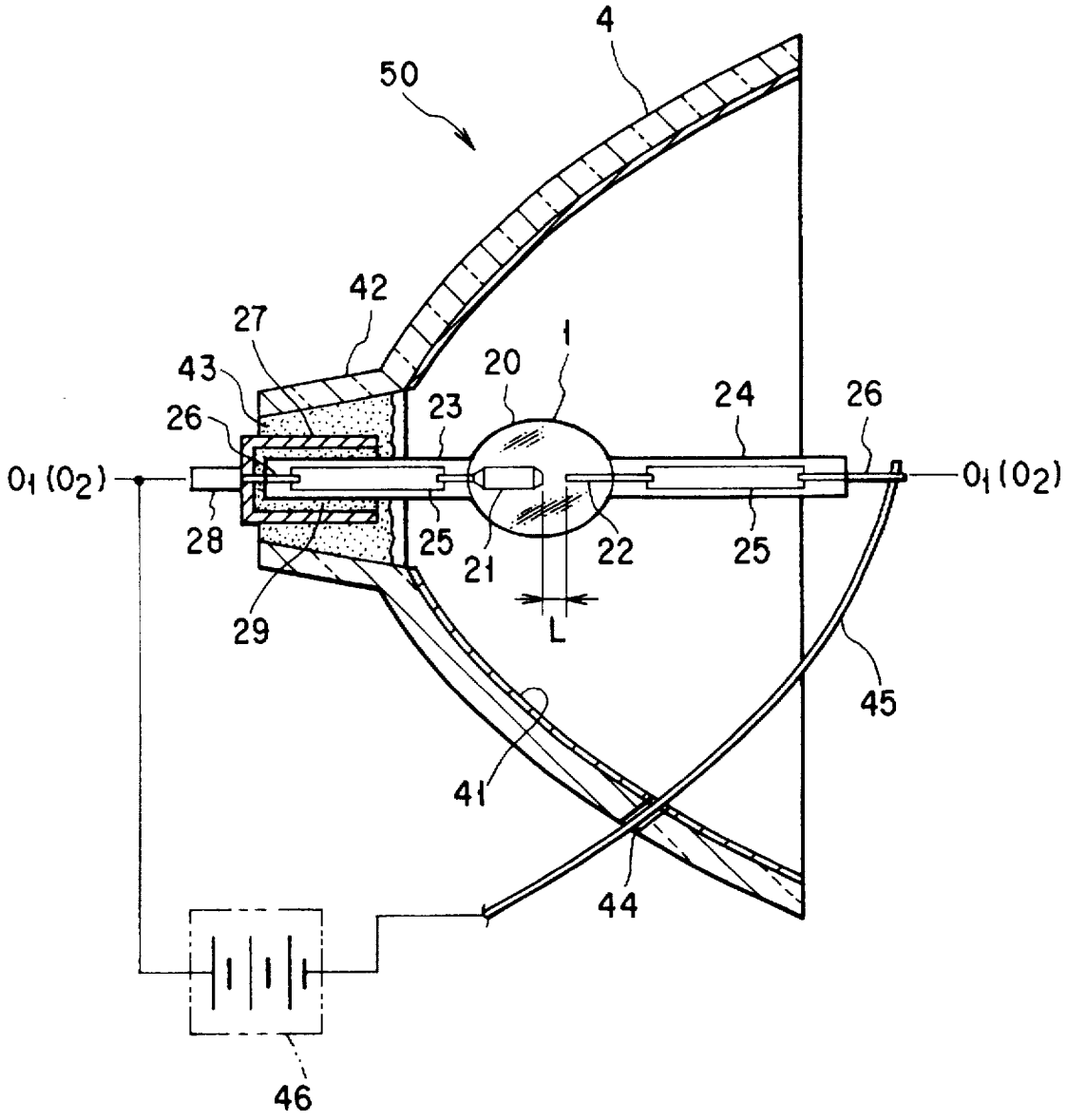
FIG. 7 is a sectional view showing a structure of a flood-light apparatus configured with a short arc metal halide lamp mounted on a reflector according to a third embodiment of the invention.

A third embodiment of the invention will be explained with reference to FIG. 7. FIG. 7 is a sectional view showing a structure of the flood-light apparatus 50 configured with the short arc metal halide lamp 1 mounted on the reflector 4.

In FIG. 7, the same component parts as those in the first and second embodiments are designated by the same reference numerals, respectively, and will not be described. The third embodiment is different from the first and second embodiments in that the conductive member 30 in the first embodiment and the metal oxide film 70 in the second embodiment are eliminated and a lesser amount of the binder is mixed with the ceramic adhesives 29 and 43 constituting the source of the flying binder with the intention of obviating the cause of the lighting failure.

Specifically, according to this embodiment, the content of the binder with at least one of lithium and sodium mixed as the main component thereof in the ceramic adhesives 29 and 43 is maintained in the range of less than 0.3 wt. % but not less than 0.05 wt. %.

As will be understood from FIG. 4, the content of the binder is desirably not less than 0.3 wt. % for assuring a sufficient bonding strength at the sacrifice of a large amount of vaporization of the binder. In the case where the content of the binder is reduced to less than 0.3 wt. %, on the other hand, the devitrification of and the leakage from the pinch seal portion 24 can be effectively prevented.

For a sufficient bonding strength to be secured, however, the binder content of not less than 0.05 wt. % is required.

Table 4 below shows the rate of occurrence of lighting failure with respect to the turned-on time of the lamp using a ceramic adhesive having the binder content of 0.2 wt. %.

TABLE 4

| | Lighting Failure Rate % | |
|---|---|---|
| Turned-On Time (Hrs) | Conventional Ceramic Adhesive (Binder Content 4.2 wt. %) | Ceramic Adhesive of the Invention (Binder Content 0.2 wt. %) |
| 100 | 0 | 0 |
| 300 | 3 | 0 |
| 500 | 8 | 0 |
| 1000 | 15 | 0 |
| 1500 | 35 | 0 |
| 2000 | 55 | 0 |
| 3000 | 60 | 0 |

Table 4 indicates that the use of a ceramic adhesive with the binder content of 4.2 wt. % increases the rate of occurrence of lamp lighting failure with the turned-on time. Reducing the binder content to 0.2 wt. %, by contrast, eliminates the lighting failure of the lamp until the end of the service life thereof and produces a satisfactory result.

The ignition apparatus and the flood-light apparatus 50 using this short arc metal halide lamp 1 as a light source and the color liquid crystal projector apparatus shown in FIG. 3 using them are also improved in their service life.

In the case where the conductive member 30 described in the first embodiment, the metal oxide film 50 descried in the second embodiment and the ceramic adhesive described in the third embodiment are used at the same time, or in the case where at least two of them are used at the same time, then a lamp with correspondingly improved characteristics can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A DC glow discharge lamp having a wall load of 50 to 100 w/cm$^2$ while operating, comprising:

a hermetic container of quartz glass including pinch seal portions formed at the ends thereof, respectively;

a pair of electrodes including an anode and a cathode formed in opposed relation to each other in said hermetic container;

a discharge medium containing a halogen compound and sealed in said hermetic container;

at least a mounting member fixedly mounted on at least one of said pinch seal portions of said hermetic container;

at least a ceramic adhesive containing at least one of lithium and sodium as the component thereof for bonding said sealed portions of said hermetic container and said mounting member; and a conductive member arranged around said cathode side pinch seal portion in the vicinity of the root of the cathode and electrically connected to assume the same potential as said cathode.

2. A DC glow discharge lamp according to claim 1, wherein said conductive member is arranged at said pinch seal portions rising to not lower than 500° C. while the lamp is turned on.

3. A DC glow discharge lamp according to claim 2, wherein the current density of the cathode of the lamp while turned on is not less than 1.5 A/mm$^2$.

4. A DC glow discharge lamp having a wall load of 50 to 100 w/cm$^2$ while operating, comprising:

a hermetic container of quartz glass including pinch seal portions formed at the ends thereof, respectively;

a pair of electrodes including an anode and a cathode formed in opposed relation to each other in said hermetic container;

a discharge medium containing a halogen compound and sealed in said hermetic container;

at least a mounting member fixedly mounted on at least one of said pinch seal portions of said hermetic container;

at least a ceramic adhesive containing at least one of lithium and sodium as the component thereof for bonding the pinch seal portions of said hermetic container and said mounting member; and a film of a metal oxide formed around said cathode side pinch seal portion in the vicinity of the root of the cathode.

5. A DC glow discharge lamp according to any of claims 1 or 4, wherein said ceramic adhesive contains not less than 0.3 wt. % of a binder containing at least one of lithium and sodium as the main component.

6. A DC glow discharge lamp having a wall load of 50 to 100 w/cm$^2$ while operating, comprising:

a hermetic container of quartz glass including pinch seal portions formed at the ends thereof, respectively;

a pair of electrodes including an anode and a cathode formed in opposed relation to each other in said hermetic container;

a discharge medium sealed in said hermetic container;

at least a mounting member fixedly mounted on at least one of said pinch seal portions of said hermetic container; and at least a ceramic adhesive containing a binder of less than 0.3 wt. % but not less than 0.05 wt. % with at least one of lithium and sodium as the main component thereof for bonding said pinch seal portion of said hermetic container and said mounting member to each other.

7. A DC glow discharge lamp according to any one of claim 1, 4 or 6, further comprising:

ignition means for turning on said DC glow discharge lamp in stable DC fashion.

8. A flood-light apparatus comprising:

a DC glow discharge lamp according to any one of claim 1, 4 or 6, and a reflector containing said DC glow discharge lamp having said pinch seal portions bonded by ceramic adhesive for reflecting the light radiated from said lamp.

9. A projector apparatus comprising:

a flood light apparatus according to claim 8;

a liquid crystal panel on which the light radiated from said flood-light apparatus is projected; and liquid crystal driving means for driving said liquid crystal display panel.

* * * * *

UNITED STATES PATENT AND TRADEMARK OFFICE

CERTIFICATE OF CORRECTION

PATENT NO. : 5,789,850

DATED : August 4, 1998

INVENTOR(S) : Y. Iwafuji et al.

It is certified that error appears in the above-identified patent and that said Letters Patent is hereby corrected as shown below:

| COLUMN | LINE | |
|---|---|---|
| 14 (Claim 8, | 5 line 5) | after "by" insert --a-- |

Signed and Sealed this

Ninth Day of February, 1999

*Attest:*

*Acting Commissioner of Patents and Trademarks*

*Attesting Officer*